US007111568B1

(12) United States Patent
Sakuma et al.

(10) Patent No.: US 7,111,568 B1
(45) Date of Patent: Sep. 26, 2006

(54) COVER STITCH SEWING MACHINE

(75) Inventors: Tohru Sakuma, Yamagata (JP); Shigenori Kudoh, Yamagata (JP)

(73) Assignee: Suzuki Manufacturing, Ltd., Yamagata (JP)

( * ) Notice: Subject to any disclaimer, the term of this patent is extended or adjusted under 35 U.S.C. 154(b) by 0 days.

(21) Appl. No.: 11/336,919

(22) Filed: Jan. 23, 2006

(30) Foreign Application Priority Data

Aug. 16, 2005 (JP) ..... 2005-235708

(51) Int. Cl.
*D05B 49/00* (2006.01)
*D05B 47/00* (2006.01)
*D05B 1/00* (2006.01)

(52) U.S. Cl. ..... 112/247; 112/254; 112/200

(58) Field of Classification Search ..... 112/241–247, 112/254, 255, 163, 165, 197, 199, 200
See application file for complete search history.

(56) References Cited

U.S. PATENT DOCUMENTS 2,937,605 A * 5/1960 Walling et al. ..... 112/254
3,545,392 A * 12/1970 Fresard ..... 112/241
4,325,314 A * 4/1982 Niem ..... 112/199
4,736,698 A * 4/1988 Inagaki ..... 112/247
4,791,876 A * 12/1988 Sasaki et al. ..... 112/241
4,817,545 A * 4/1989 Mikuni et al. ..... 112/241
4,934,291 A * 6/1990 Yamamoto ..... 112/163
5,131,338 A * 7/1992 Vogel et al. ..... 112/241

FOREIGN PATENT DOCUMENTS

JP 2000-093671 4/2000

* cited by examiner

*Primary Examiner*—Ismael Izaguirre
(74) *Attorney, Agent, or Firm*—Bacon & Thomas, PLLC

(57) ABSTRACT

In a cover stitch sewing machine which forms double chain stitch seams, needle threads are pulled out from the needle thread tensioning devices, passing over a thread hanging point on a needle thread pulling-up spring and the needle thread take-up completes drawing-up of the needle threads after needle thread loops of the respective needles are seized by the looper. The sewing material is then fed one feed pitch as the needles are moved down and the needle thread take-up draws out the needle threads, while the needle threads are pulled up at the thread hanging point by the elasticity of the needle thread pulling-up spring, thus preventing slack in the needle threads below the needle thread eyes. The threads which are connected with the needle thread loops, are drawn up by the thread hanging point of the needle thread take-up against the resiliency of the needle thread pulling-up spring.

14 Claims, 14 Drawing Sheets

COVER STITCH SEWING MACHINE

CROSS-REFERENCE TO RELATED APPLICATIONS

"Not Applicable"

STATEMENT REGARDING FEDERALLY SPONSORED RESEARCH OR DEVELOPMENT

"Not applicable"

THE NAMES OF THE PARTIES TO A JOINT RESEARCH AGREEMENT

"Not Applicable"

INCORPORATION-BY-REFERENCE OF MATERIAL SUBMITTED ON A COMPACT DISK

"Not applicable"

BACKGROUND OF THE INVENTION

1. Field of the Invention

The present invention relates to a cover stitch sewing machine, and more particularly to a cover stitch sewing machine in which at the time of sewing with a fine stitch pitch, when a needle thread take-up runs out needle threads by lowering a plurality of needles, the needle threads are taken up due to the elasticity of a needle thread pulling-up spring thus preventing the occurrence of a slack of the needle threads which extendedly exist below needle thread eyes whereby a double chain stitch seams having no skips are formed.

2. Description of Related Art

Conventionally, there has been known a cover stitch sewing machine in which a plurality of needle threads are supplied to a plurality of needle thread eyes of a plurality of needles by way of a plurality of needle thread tensioning devices and a needle thread take-up, a looper thread is supplied to a looper from a thread spool by way of a looper thread tensioning device and a looper thread take-up, and a cover stitch of double chain stitch seams is formed in a sewing material on a needle plate due to the intertwining of the needle threads of the respective needles and the looper thread of the looper in response to a cooperative operation of the plurality of needles and the looper (see Japanese Patent Laid-open 2000-93671).

BRIEF SUMMARY OF THE INVENTION

In the cover stitch sewing, to obtain a beautiful finish of seams even when a kind and a size of needle threads differ, the seams are formed by performing thread tightening and feeding due to a cooperative operation of needle thread tensioning devices, a needle thread take-up and a looper thread take-up. In such a cover stitch sewing machine, an extremely cumbersome manual manipulation becomes necessary for adjusting the needle thread tensioning devices. Particularly, in the cover stitch sewing machine, the number of sewing threads becomes large and hence, it is extremely cumbersome to take a needle thread tensioning balance among the sewing threads.

Here, in the cover stitch sewing machine, there may be a case in which waved overlock stitches are applied to an end periphery of a sewing material (see Japanese Patent Laid-open 2004-305381, for example) thus using the cover stitch sewing machine as a so-called cover and wave lock stitches sewing machine.

In this case, three needles and one double chain looper are used for cover stitch sewing, for example, while two needles and two upper and lower loopers are used for the wave lock stitches sewing. Accordingly, eight sewing threads are used.

In the wave lock stitches sewing, when the fine feed pitch is elongated, a shape of wave becomes coarse and hence, the seams cannot obtain a beautiful finish thus exhibiting the poor appearance. Accordingly, the sewing is performed with the fine stitch length (for example, 2.5 mm or less).

Here, the feeding of the needle thread take-up and the feeding of a fabric 83 are synchronized with each other at given timings. That is, in the elevation and lowering of the needle thread take-up, a drawing-up quantity and a feed quantity of the needle threads 80 are fixed. In such a circumstance, when the cover and wave lock stitches sewing is performed with a coarse stitch length (for example, exceeding 2.5 mm), the coarse stitch length increases a drawing-up consumption of needle threads 80 attributed to the feeding of the fabric 83. Accordingly, although a feed quantity of the needle threads 80 during the lowering of the needle thread take-up is fixed, there is no possibility that a slack is generated in the needle threads 80 which extendedly exist below needle thread eyes 82 when the needles 81 are lowered (FIG. 9(A)). On the other hand, when the cover and wave lock stitches sewing is performed with a fine stitch length (2.5 mm or less, for example), while the drawing-up quantity of the needle threads 80 attributed to the feeding of the close 83 with the fine stitch pitch is decreased, the feed quantity of the needle threads 80 is fixed during the lowering of the needle thread take-up and hence, a slack 84 is generated in the needle threads 80 which are extendedly exist below the needle thread eyes 82 when the needles 81 are lowered and the slack 84 clings to the needles 81.

In this manner, at the time of sewing with the fine stitch pitch, when the needles are lowered and the needle thread take-up feeds the needle threads, the slack is generated in the needle threads which extendedly exist below the needle thread eyes and hence, the needle threads are formed in a ring shape due to the twisted performance of the needle threads per se and the descending needles penetrate ring-like portions of the needle threads whereby loops of the needle threads which are expected to form the seams as the looper scoops when the needles are elevated are not formed thus giving rise to skips.

Further, as shown in FIG. 10, when each needle thread tensioning device 85 is constituted of a pair of thread tensioning disks 86, approach angles θ, θ' of the needle threads 80 which move into between the pair of thread tensioning disks 86 from needle thread spools are not fixed and become unstable due to a kind, the nature and a size of the needle threads 80. Accordingly, the drawing-up and the feeding of the needle threads 80 by the needle thread take-up become unstable thus promoting the occurrence of the above-mentioned skips.

Accordingly, it is an object of the present invention to provide a cover stitch sewing machine in which a drawing-up consumption of needle threads attributed to close feeding is decreased at the time of sewing with a fine stitch pitch and hence, when a plurality of needles are lowered and a needle thread take-up feeds needle threads, the needle threads are taken up by the resiliency of a needle thread pulling-up spring thus preventing the occurrence of a slack of the needle threads which extendedly exist below needle thread eyes, whereby when the plurality of needles are elevated from a lowermost point, a tip of a looper forms needle thread loops respectively formed above a plurality of needle thread eyes into a stable loop shape for every seam thus preventing skips and providing beautiful double chain stitch seams.

Further, it is another object of the present invention to provide a cover stitch sewing machine in which when each one of a plurality of needle thread tensioning devices is constituted of a pair of thread tensioning disks, an approach angle of the needle thread which moves into between the pair of thread tensioning disks is fixed on an upstream side of each pair of thread tensioning disks and hence, the drawing-up and the feeding of the needle threads attributed to the needle thread take-up can be made stable with a fixed thread tension whereby the occurrence of the above-mentioned skips can be prevented and beautiful double chain stitch seams can be formed.

To achieve the above-mentioned objects, the present invention is directed to a cover stitch sewing machine in which a plurality of needle threads are supplied to a plurality of needle thread eyes of a plurality of needles from a needle thread spool by way of a plurality of needle thread tensioning devices and a needle thread take-up, a looper thread is supplied to a looper thread eye from a looper thread spool by way of a looper thread tensioning device and a looper thread take-up, and a cover stitch of a double chain stitch seam is formed in a sewing material on a needle plate due to the intertwining of the needle threads of the respective needles and the looper thread of the looper in response to a cooperative operation of the plurality of needles and the looper, wherein the needle thread take-up includes a needle thread pulling-up spring on which the needle threads which are pulled out from the needle thread tensioning devices are thread-hung together with the needle thread take-up by a thread hanging point and hence, the needle thread take-up completes the drawing-up of the needle threads by the thread hanging point after needle thread loops of the respective needles are seized by the looper, the sewing material is fed by one feed pitch, when the plurality of needles are moved down and the needle thread take-up runs out the needle threads, the needle threads are pulled up by the elasticity by the thread hanging point of the needle thread pulling-up spring thus preventing the occurrence of a slack of the needle threads which extendedly exist below the needle thread eyes and, at the same time, the plurality of needles move into the inside of substantially triangular spaces formed by the needle thread loops and the looper threads before one feed pitch, the looper is shed from the needle thread loops, and the needle threads which are connected with the needle thread loops from which the looper is shed are drawn-up by the thread hanging point of the needle thread take-up against the resiliency of the needle thread pulling-up spring.

The needle thread pulling-up spring has one end thereof fixed to the needle thread take-up and another end thereof positioned elastically and flexibly on a thread hanging point of the needle thread take-up.

The needle thread pulling-up spring has a quantity of flexibility which absorbs the slack of the needle threads which is generated at the time of sewing with at least a finest stitch length.

The needle thread pulling-up spring has an elastic strength which is smaller than a drawing-up force of the needle thread take-up and is sufficient to take up a slack of the needle threads which extendedly exist below the thread eyes.

Each one of the plurality of needle thread tensioning devices is constituted of a pair of thread tensioning disks and includes an implanted-bristle brush which fixes an approach angle of the needle thread which moves into between the pair of thread tensioning disks on an upstream side of each pair of thread tensioning disks.

With respect to the implanted-bristle brush, a diameter of implanted bristles is 20 to 30 gr/1000 m of synthetic fiber and, a length of the implanted bristles is 2 mm to 3 mm, and the density of the implanted bristles is 30 pieces/$mm^2$ to 50 pieces/$mm^2$.

The needle threads are held between a plate which is brought into contact with an implanted-bristle tip face of the implanted bristle and the implanted bristle.

According to the cover stitch sewing machine of the present invention, the slack of the needle thread extendedly exiting below the needle thread eye which occurs when the plurality of needles are lowered at the time of sewing with the finest stitch length can be taken up due to the elasticity of the needle thread pulling-up spring thus preventing the skip.

Further, according to the cover stitch sewing machine of the present invention, when each one the plurality of needle thread tensioning devices is constituted of a pair of thread tensioning disks, by fixing the approach angle of the needle thread which moves into between the pair of thread tensioning disks on the upstream side of each pair of thread tensioning disks, it is possible to prevent the occurrence of the above-mentioned skip.

DETAILED DESCRIPTION OF THE INVENTION

Figure 1:
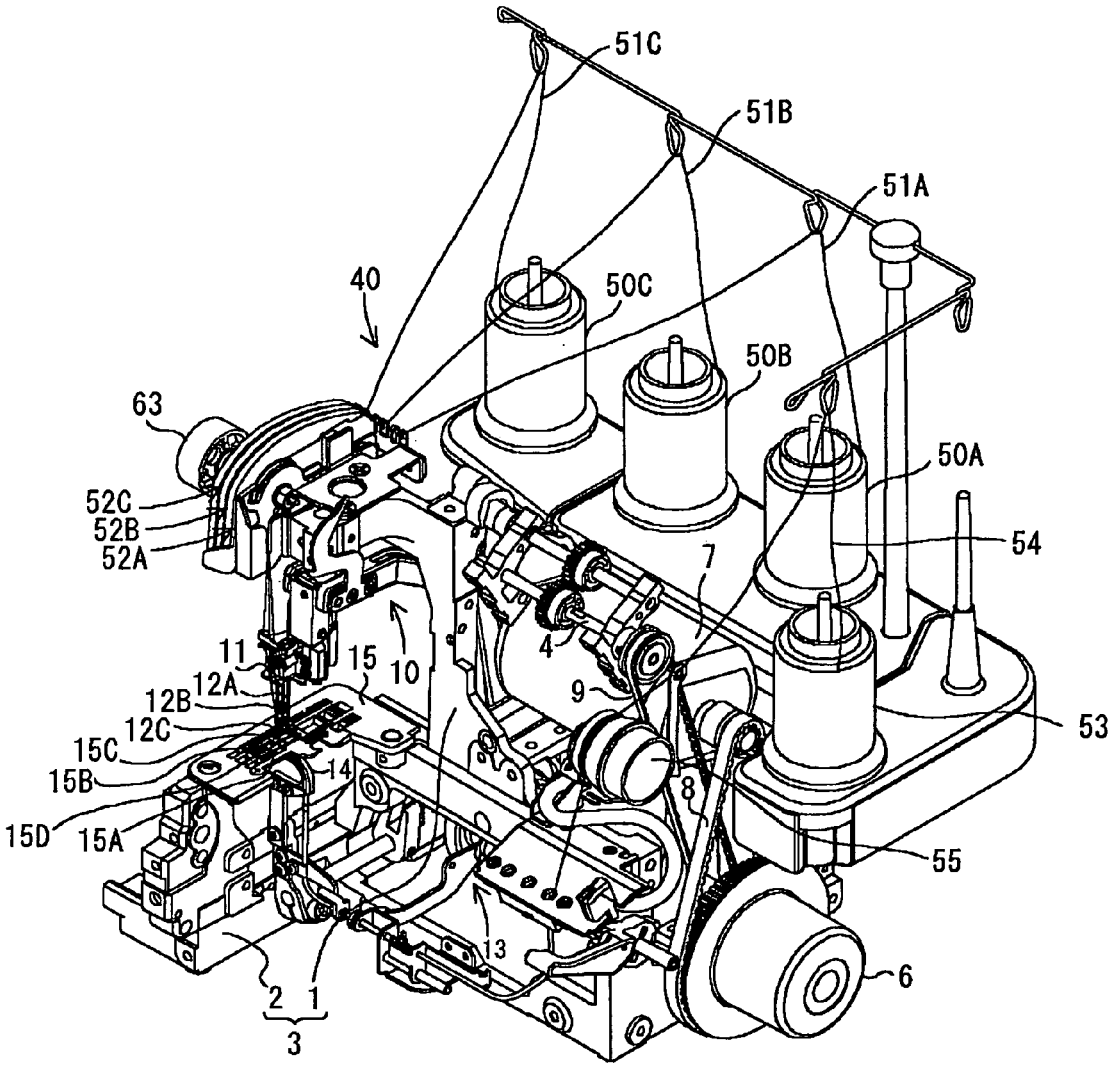
FIG. 1 is an overall perspective view of a cover stitch sewing machine of the present invention.

Hereinafter, preferred embodiments of a cover stitch sewing machine of the present invention are explained in conjunction with the drawing.

As shown in FIG. 1, the cover stitch sewing machine mounts respective constitutional elements on a frame 3 which is constituted of an arm 1 and a bed 2.

A needle thread take-up shaft 4 which drives a needle thread take-up mechanism 40 is pivotally supported on the arm 1, while a main shaft 5 is pivotally supported on the bed 2. A pulley 6 is mounted on the main shaft 5 and the pulley 6 is driven by a motor 7 by way of a timing belt 8. The needle thread take-up shaft 4 is driven by the main shaft 5 (FIG. 2) by way of a timing belt 9.

Further, to the main shaft 5, a needle holder 11 which performs a vertical linear reciprocating motion by a needle drive mechanism 10 is connected, while three needles 12A, 12B, 12C are fixed to the needle holder 11.

To the main shaft 5, one looper 14 which performs an arcuate reciprocating motion which intersects motion loci of three needles 12A, 12B, 12C by a looper drive mechanism 13 is connected.

Figure 8:
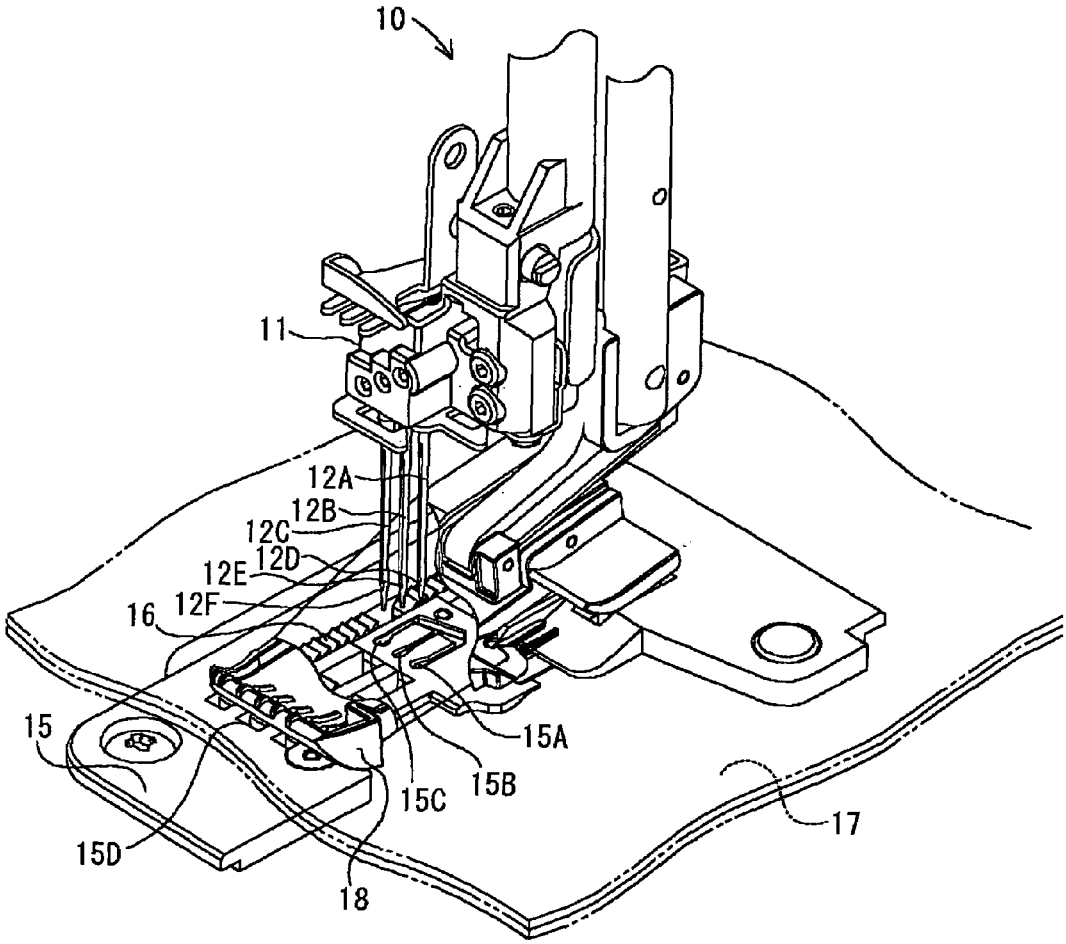
FIG. 8 is a perspective view showing the relationship among needles, a needle plate, feed dogs, a pressure foot in the cover stitch sewing machine shown in FIG. 1.

Further, the cover stitch sewing machine includes a needle plate 15 in which needle throats 15A, 15B, 15C for three needles 12A, 12B, 12C and a feed window 15D for a feed dog 16 are formed and a pressure foot 18 which clamps a sewing material 17 together with the needle plate 15, wherein the looper 14 is arranged below the needle plate 15 (FIG. 8).

Three needles 12A, 12B, 12C are fixed to the needle holder 11 in a slightly vertically displaced manner. Due to such a constitution, it is possible to allow the respective three needles 12A, 12B, 12C to intersect each other at optimum heights with respect to the looper 14.

Figure 2:
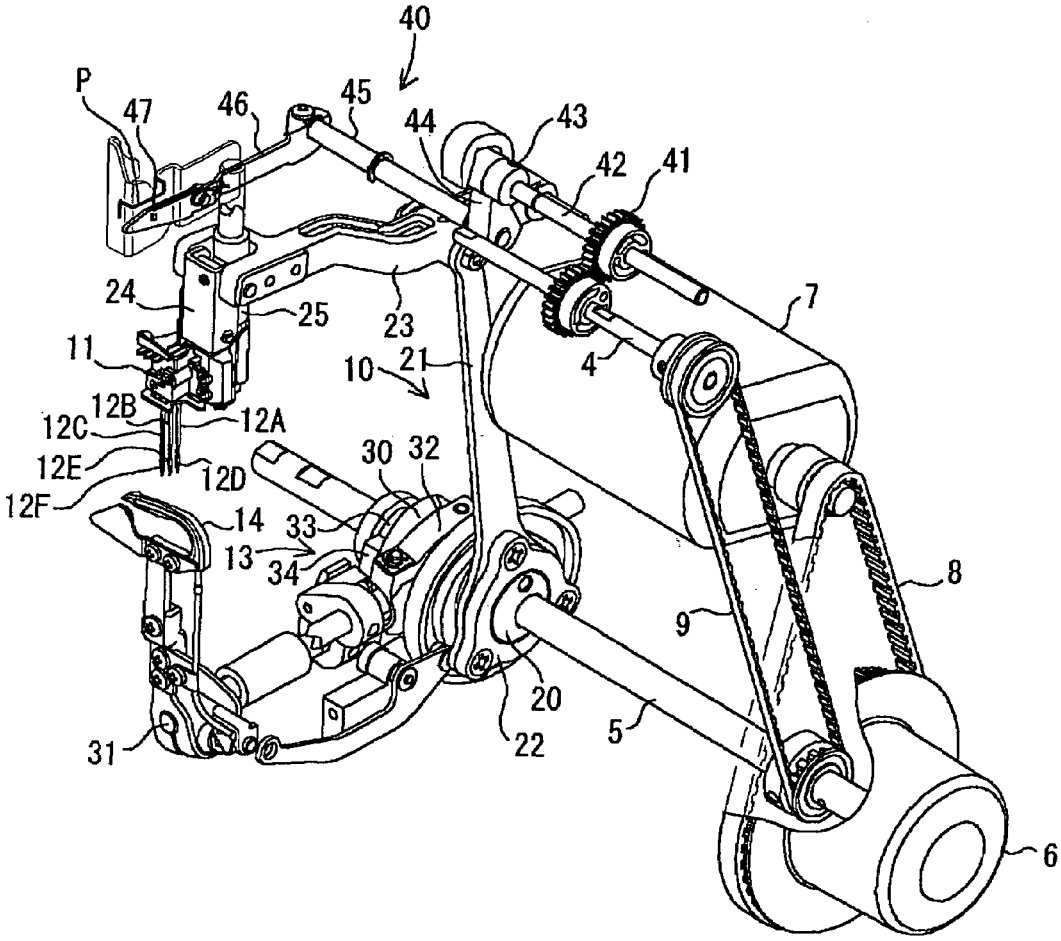
FIG. 2 is a perspective view showing a needle drive mechanism, a looper drive mechanism and a needle thread take-up drive mechanism in the cover stitch sewing machine shown in FIG. 1.

As shown in FIG. 2, the needle drive mechanism 10 is configured such that a cam follower 22 of a needle holder drive rod 21 is driven by an eccentric cam 20 which is fixed to the main shaft 5, a needle holder drive rod 21 imparts the vertical tilting motion to a needle holder drive arm 23 so as to allow the needle holder 11, that is, three needles 12A, 12B, 12C to perform the vertical linear reciprocating motion by way of a link 24 while being guided by a needle rod 25.

The looper drive mechanism 13 is configured such that a looper shaft 31 on which the looper 14 is mounted is tilted by an inclined groove cam 30 fixedly secured to the main shaft 5 by way of a cam follower 32, and the looper shaft 31 is reciprocally moved in the axial direction by a triangular cam 33 by way of a bifurcated rod 34 thus allowing the looper 14 to perform the elliptical reciprocating motion.

The needle thread take-up drive mechanism 40 is configured such that the needle thread take-up drive shaft 4 is connected to a needle thread take-up drive cam shaft 42 by way of a pair of gears 41, a bifurcated arm 44 is allowed to tilt a take-up mounting shaft 45 by way of a needle thread take-up drive cam 43 which is fixedly mounted on the needle thread take-up drive shaft 42 so as to vertically tilt a needle thread take-up 46 mounted on the take-up mounting shaft 45.

Figure 5:
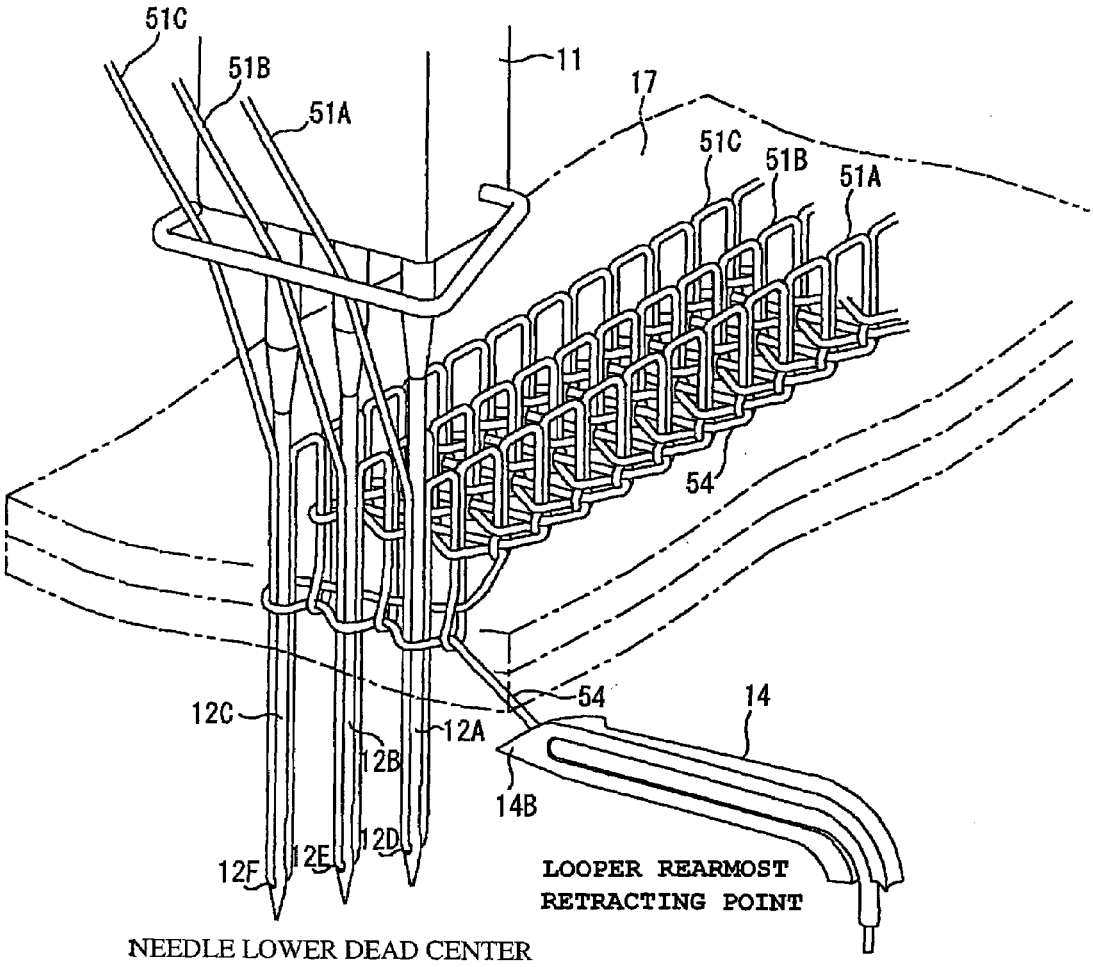
FIG. 5(A) is an operation explanatory view of the cover stitch sewing machine of the present invention.
FIG. 5(B) is an operation explanatory view of the cover stitch sewing machine of the present invention.
FIG. 5(C) is an operation explanatory view of the cover stitch sewing machine of the present invention.
FIG. 5(D) is an operation explanatory view of the cover stitch sewing machine of the present invention.
FIG. 5(E) is an operation explanatory view of the cover stitch sewing machine of the present invention.
Figure 5:
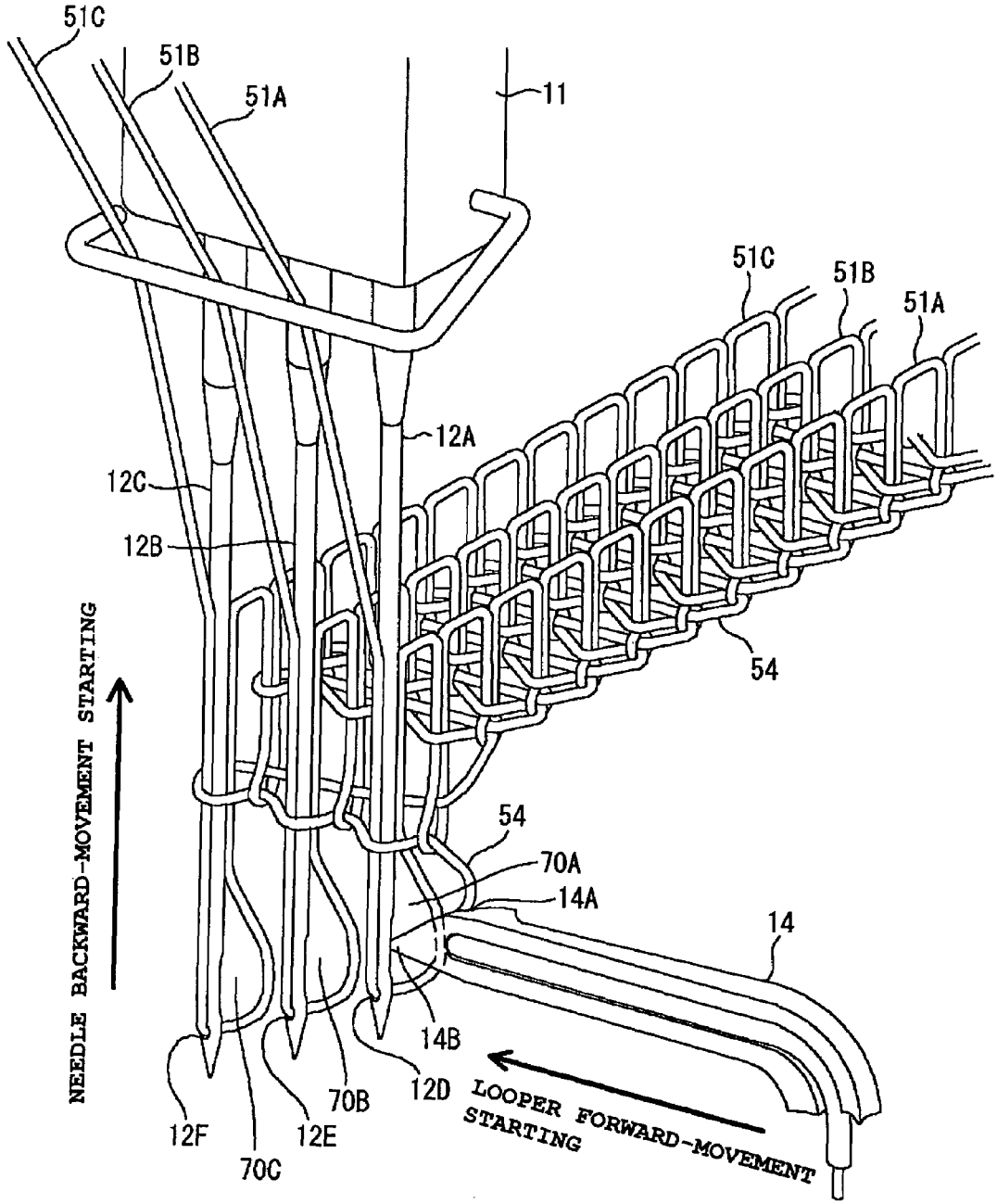

In the cover stitch sewing machine of the present invention, due to the above-mentioned needle drive mechanism 10, looper drive mechanism 13 and needle thread take-up drive mechanism 40, the plurality of needle threads 51A, 51B, 51C (FIG. 5(A)) are supplied to needle thread eyes 12D, 12E, 12F (FIG. 8) of the plurality of needles 12A, 12B, 12C from the needle thread spools 50A, 50B, 50C by way of a plurality of needle thread guides 67A, 67B, 67C, a plurality of needle thread tensioning devices 52A, 52B, 52C and the needle thread take-up 46, while the looper thread 54 is supplied to the looper thread eye 14A of the looper 14 from the looper thread spool 53 by way of the looper thread tensioning device 55 and the looper thread take-up 56. Then, corresponding to the cooperative operation of the plurality of needles 12A, 12B, 12C and the looper 14, due to the intertwining of the needle threads 51A, 51B, 51C of the respective needles and the looper thread 54 of the looper 14, the cover stitch sewing having the double chain stitch seams is formed on the sewing material 17 on the needle plate 15.

The above-mentioned needle drive mechanism 10, looper drive mechanism 13 and needle thread take-up drive mechanism 40 are driven in synchronism. Accordingly, three needles 12A, 12B, 12C, the looper 14 and the needle thread take-up 46 are driven in synchronism. That is, the looper 14 is configured to perform, below the needle plate 15, the arcuate reciprocating motion in synchronism with the vertical linear reciprocating motion of three needles 12A, 12B, 12C and the elliptical motion in the horizontal direction. The drive mechanism is configured such that when the arcuate reciprocating motion of the looper 4 is observed from the needle plate 15 side, the looper 4 performs the elliptical motion.

Figure 7:
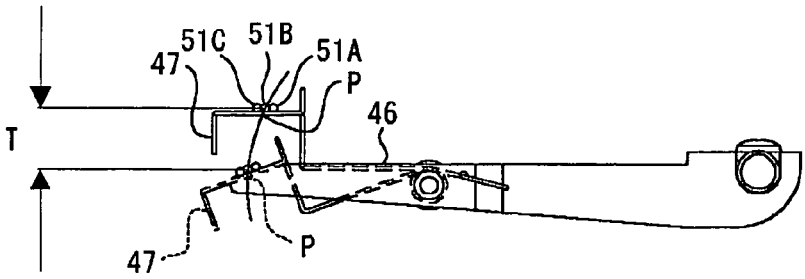
FIG. 7 is an operation explanatory view showing the needle thread take-up in the cover stitch sewing machine shown in FIG. 1.

In the cover stitch sewing machine of the present invention, the needle thread take-up 46 includes a needle thread pulling-up spring 47 on which the needle threads 51A, 51B, 51C which are pulled out from the needle thread tensioning devices 52A, 52B, 52C are thread-hung together with the needle thread take-up 46 by a thread hanging point P (FIG. 2, FIG. 7).

The needle thread pulling-up spring 47 has one end thereof connected to the needle thread take-up 46 and another end thereof elastically, flexibly positioned above, preferably 6 mm to 7 mm above the thread hanging point P of the needle thread take-up 46.

The needle thread pulling-up spring 47 includes a quantity of flexibility T to absorb the slack of the needle threads 51A, 51B, 51C which is generated at the time of sewing with at least a finest stitch length.

The needle thread pulling-up spring 47 has the elasticity which is smaller than a drawing-up force of the needle thread take-up 46 and is sufficient to take up the slack of the needle threads 51A, 51B, 51C which extend below the needle thread eyes 12D, 12E, 12F.

Figure 3:
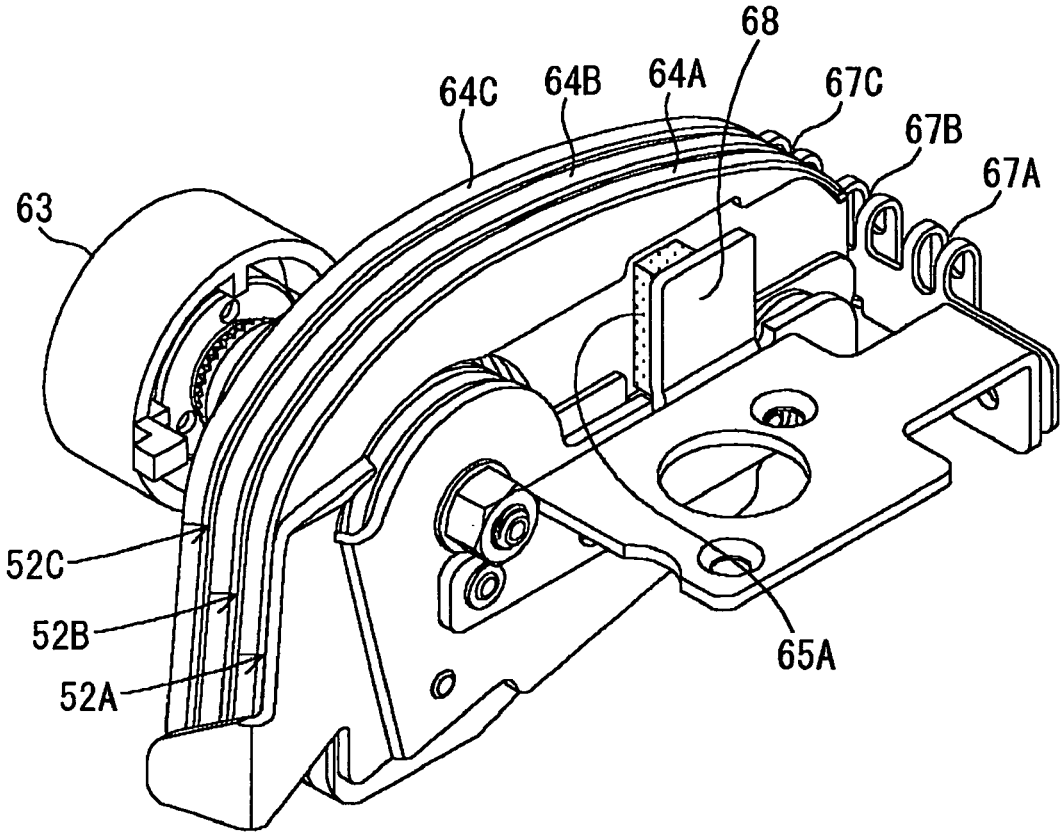
FIG. 3 is a perspective view showing needle thread tensioning devices in a cover stitch sewing machine shown in FIG. 1.
Figure 4:
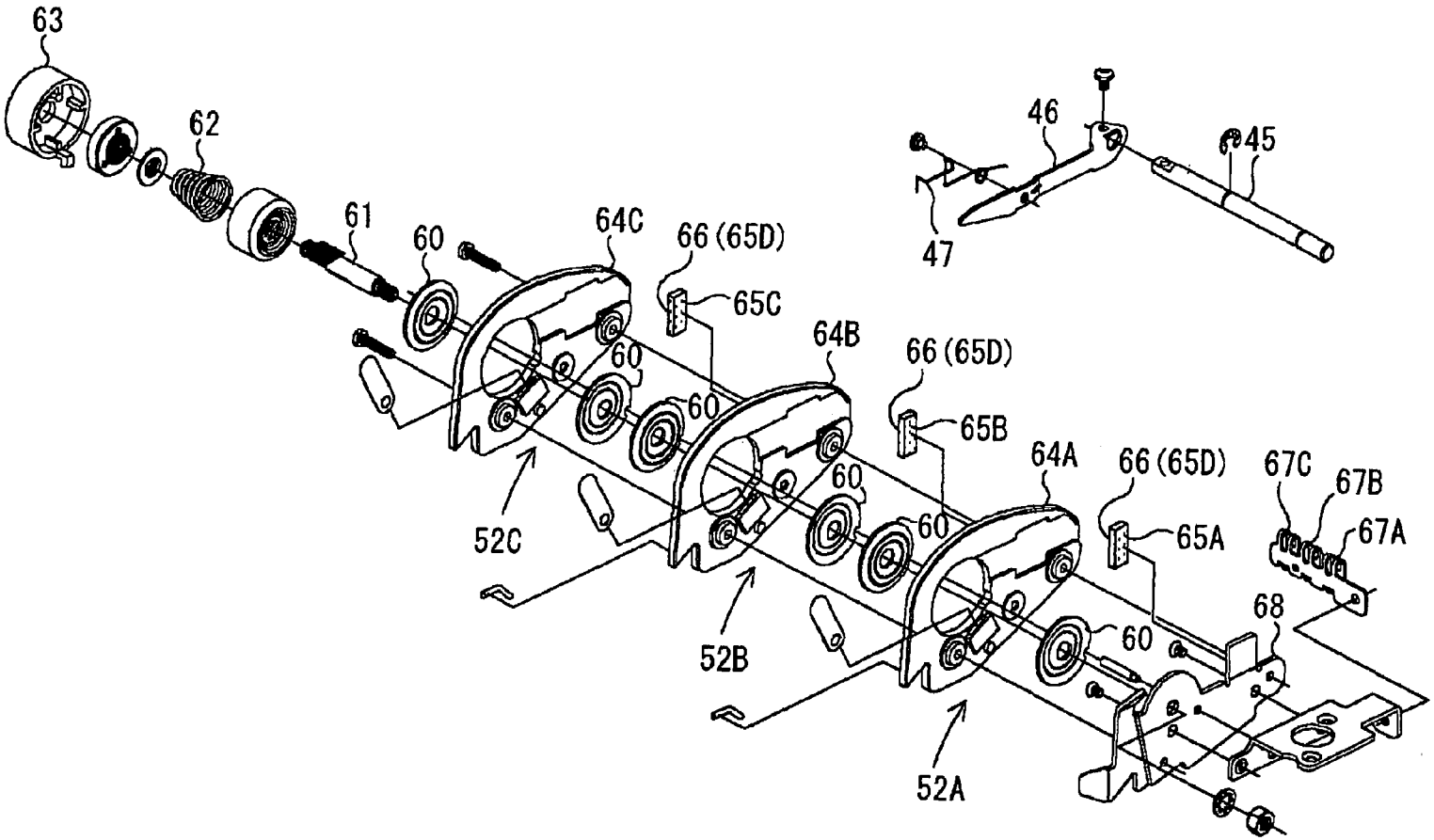
FIG. 4 is an exploded perspective view showing the needle thread tensioning devices in a cover stitch sewing machine shown in FIG. 1.

As shown in FIG. 1, FIG. 3 and FIG. 4, each one of three needle thread tensioning devices 52A, 52B, 52C is constituted of a pair of thread tensioning disks 60, a thread adjustment rod 61 is loosely fit in the centers of the pair of thread tensioning disks 60, wherein three pairs of thread tensioning disks 60 are brought into pressure contact with each other by one thread tensioning spring 62, and are fixed to each other using one thread tensioning nut 63 in a thread tensioning manner. Since three needle thread tensioning devices 52A, 52B, 51C are integrally formed in this manner, the devices can be miniaturized and, at the same time, three needle thread tensioning devices 52A, 52B, 52C can be simultaneously manually adjusted using one thread tensioning nut 63.

On the needle thread tensioning devices 52A, 52B, 52C, thread guide plates 64A, 64B, 64C which respectively guide the respective needle threads 51A, 51B, 51C to the respective thread tensioning disks 60 are mounted using a needle thread tensioning device mounting plate 68.

Figure 6:
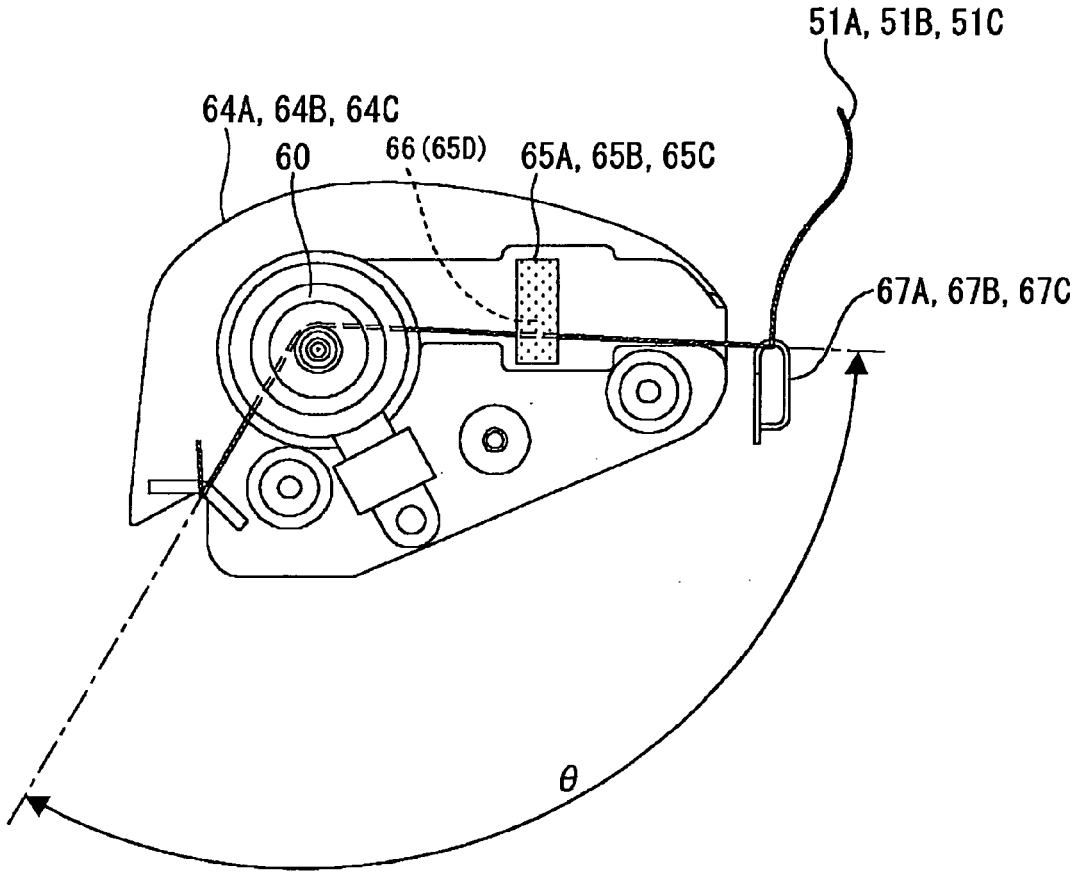
FIG. 6 is an operation explanatory view showing the needle thread tensioning devices in the cover stitch sewing machine shown in FIG. 1.

The thread guide plates 64A, 64B, 64C include implanted bristle brushes 65A, 65B, 65C which fix an approach angle θ (FIG. 6) of the needle threads 51A, 51B, 51C which move into between the pair of thread tensioning disks 60 on an upstream side of the respective pairs of thread tensioning disks 60.

With respect to the implanted-bristle brushes 65A, 65B, 65C, a diameter of these implanted bristles is 20 to 30 gr/1000 m of chemical fiber (deci-Tex 25) and, a length of the implanted bristles is 2 mm to 3 mm, and the density of the implanted bristles is 30 pieces/$mm^2$ to 50 pieces/$mm^2$. Here, a usable diameter of the needle threads 51A, 51B, 51C is 0.15 to 0.25 mm.

The respective needle threads 51A, 51B, 51C are held between the respective thread guide plates 64A, 64B, 64C which are brought into contact with an implanted-bristle tip faces 66 of the implanted bristles 65A, 65B, 65C and the implanted bristles 65D.

The manner of operation of the cover stitch sewing machine having such a constitution is explained hereinafter. In case of fine stitch length (for example, 2.5 mm or less):

Along with the lowering of the plurality of needles 12A, 12B, 12C in a state that the needle threads 51A, 51B, 51C penetrate the needle thread eyes 12D, 12E, 12F thereof respectively, the needle thread take-up 46 runs out the needle threads 51A, 51B, 51C and the plurality of needles 12A, 12B, 12C are further lowered and penetrate the sewing material 17, and reach a lowermost point after passing the needle throats 15A, 15B, 15C of the needle plate 15. Here, the looper 14 is positioned at a rearmost retracting position (FIG. 5(A)).

When the plurality of needles 12A, 12B, 12C are elevated along with the drawing up of the needle threads 51A, 51B, 51C by the needle thread take-up 46 from a lowermost point, needle thread loops 70A, 70B, 70C which are formed in an upwardly extended manner from the needle thread eyes 12D, 12E, 12F of the respective needles are scooped by a tip 14B of the looper 14 in which the looper thread 54 pierces the looper thread eye 14A (FIG. 5(B)).

Figure 5C:
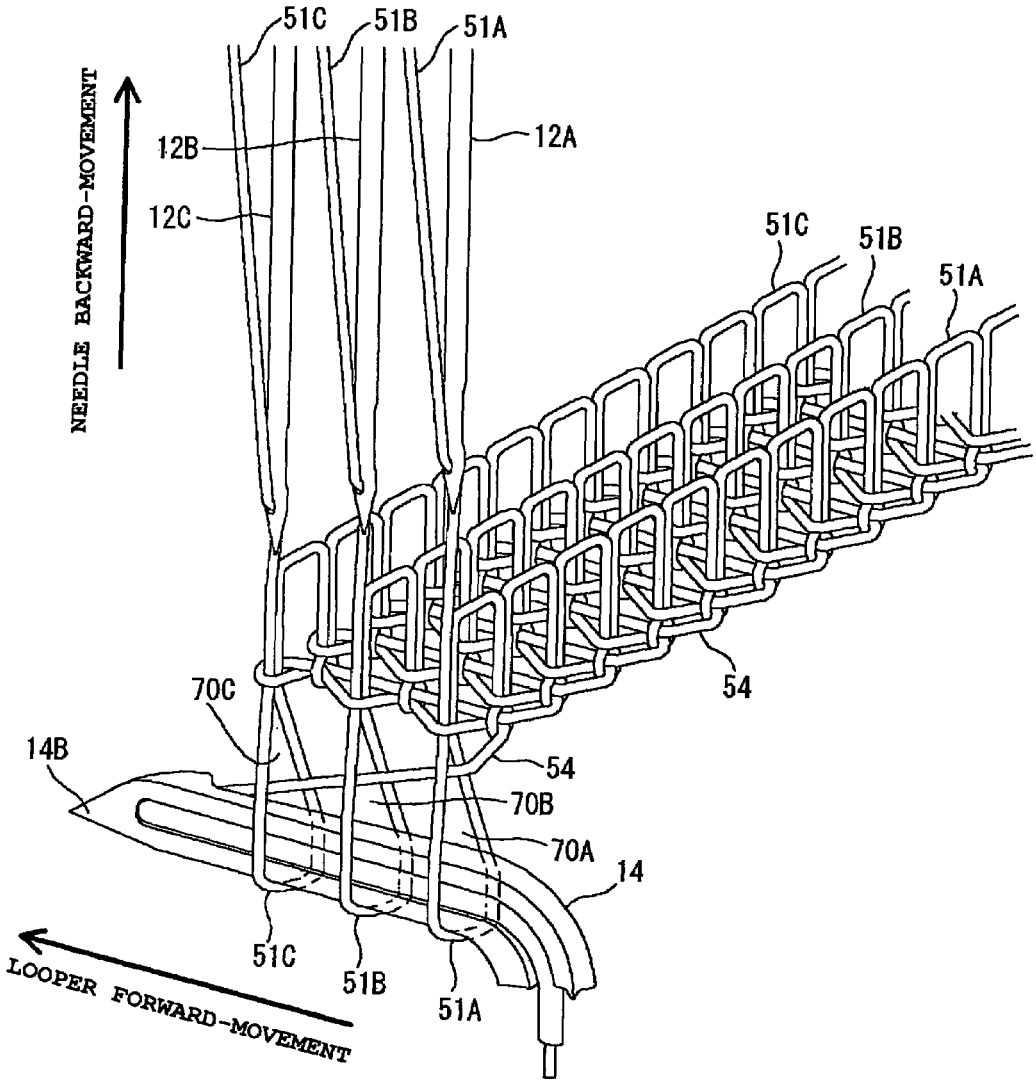
Figure 5:
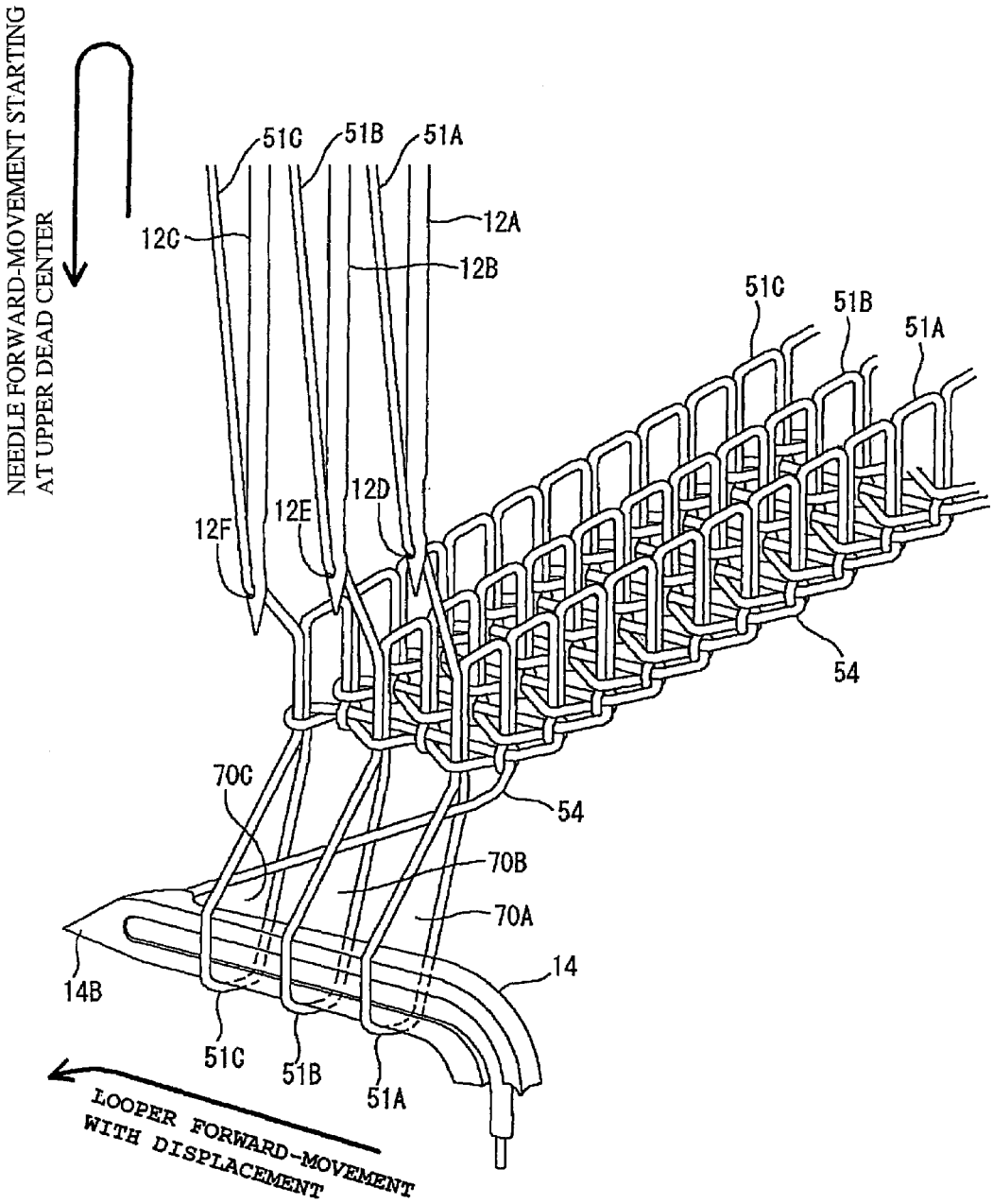
Figure 5:
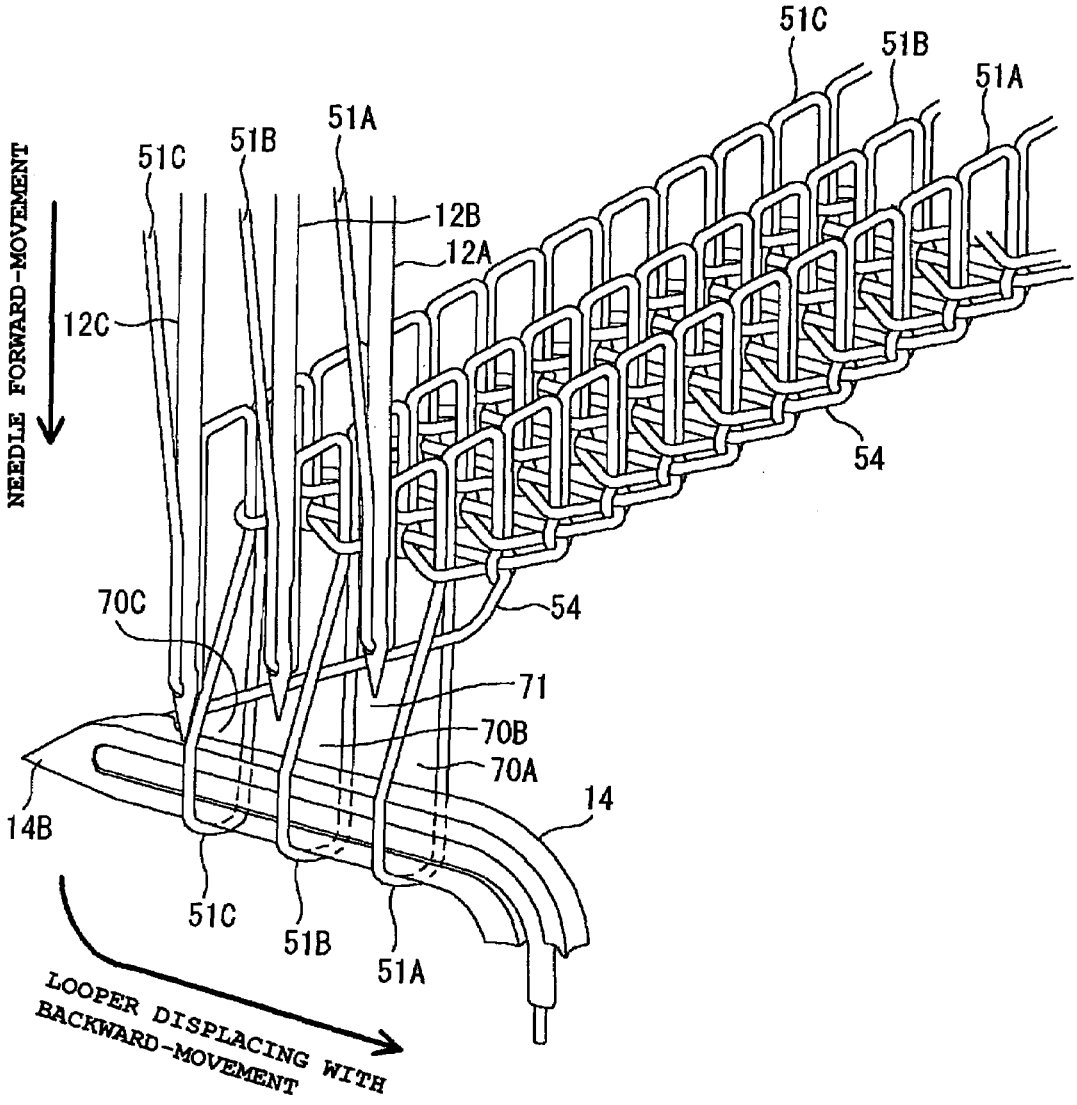

The plurality of needles 12A, 12B, 12C are further elevated and when the needle thread take-up 46 completes the drawing-up of the needle threads 51A, 51B, 51C by the thread hanging point P against the elasticity of the needle thread pulling-up spring 47 (chained line in FIG. 7), the sewing material 17 which is clamped by the needle plate 15 and the pressure foot 18 is fed by 1 feed pitch using the feed dog 16 (FIG. 5(C), FIG. 8). In this case, the pull-in consumption of the needle thread along with the feeding of fabric at the fine stitch length is small.

When the plurality of needles 12A, 12B, 12C are lowered and the needle thread take-up 46 runs out the needle threads 51A, 51B, 51C, the needle threads 51A, 51B, 51C are taken up due to the elasticity by the thread hanging point P of the needle thread pulling-up spring 47 (solid line in FIG. 7) and hence, the occurrence of the slack of the needle threads 51A, 51B, 51C which extendedly exist below the needle thread eyes 12D, 12E, 12F can be prevented (FIG. 5(D)).

Along with the retracting of the looper 14, the plurality of needles 12A, 12B, 12C are moved into the inside of a triangle 71 which is formed by the needle thread loops 70A, 70B, 70C before feeding by one feed pitch and the looper thread 54 (FIG. 5(E)).

The looper 14 is further retracted and is shed from the needle thread loops 70A, 70B, 70C, and the needle threads 51A, 51B, 51C which are connected to the needle thread loops 70A, 70B, 70C from which the looper 14 is shed are drawn up by the thread tensioning point P of the needle thread take-up 46 against the elasticity of the needle thread pulling-up spring 47.

In this manner, although the pulling-in consumption of the needle threads 51A, 51B, 51C along with the fabric feeding at the fine stitch length is small, the needle threads 51A, 51B, 51C which extendedly exist below the needle thread eyes 12D, 12E, 12F do not generate the slack. Accordingly, it is possible to form the double chain stitch seams without skips.

By repeating the above-mentioned cover stitch sewing operation, it is possible to continuously form the double chain stitch seams in a stable manner.

With respect to the cover stitch sewing machine of the present invention, in supplying the needle threads 51A, 51B, 51C to the needle thread take-up 46, the needle threads 51A, 51B, 51C are respectively moved into between the pair of thread tensioning disks 60 from the upstream side of the pair of thread tensioning disks 60 of the needle thread tensioning devices 52A, 52B, 52C by way of the implanted-bristle brushes 65A, 65B, 65C. The needle threads 51A, 51B, 51C are held and guided between the respective thread guide plates 64A, 64B, 64C which are brought into contact with implanted-bristle tip faces 66 of the implanted-bristle brushes 65A, 65B, 65C and the implanted-bristle tip 65D.

In this manner, by fixing an approach angle θ of the needle thread, it is possible to further obviate the occurrence of the above-mentioned skips.

In case of coarse stitch length (for example, exceeding 2.5 mm)

Figure 9A:
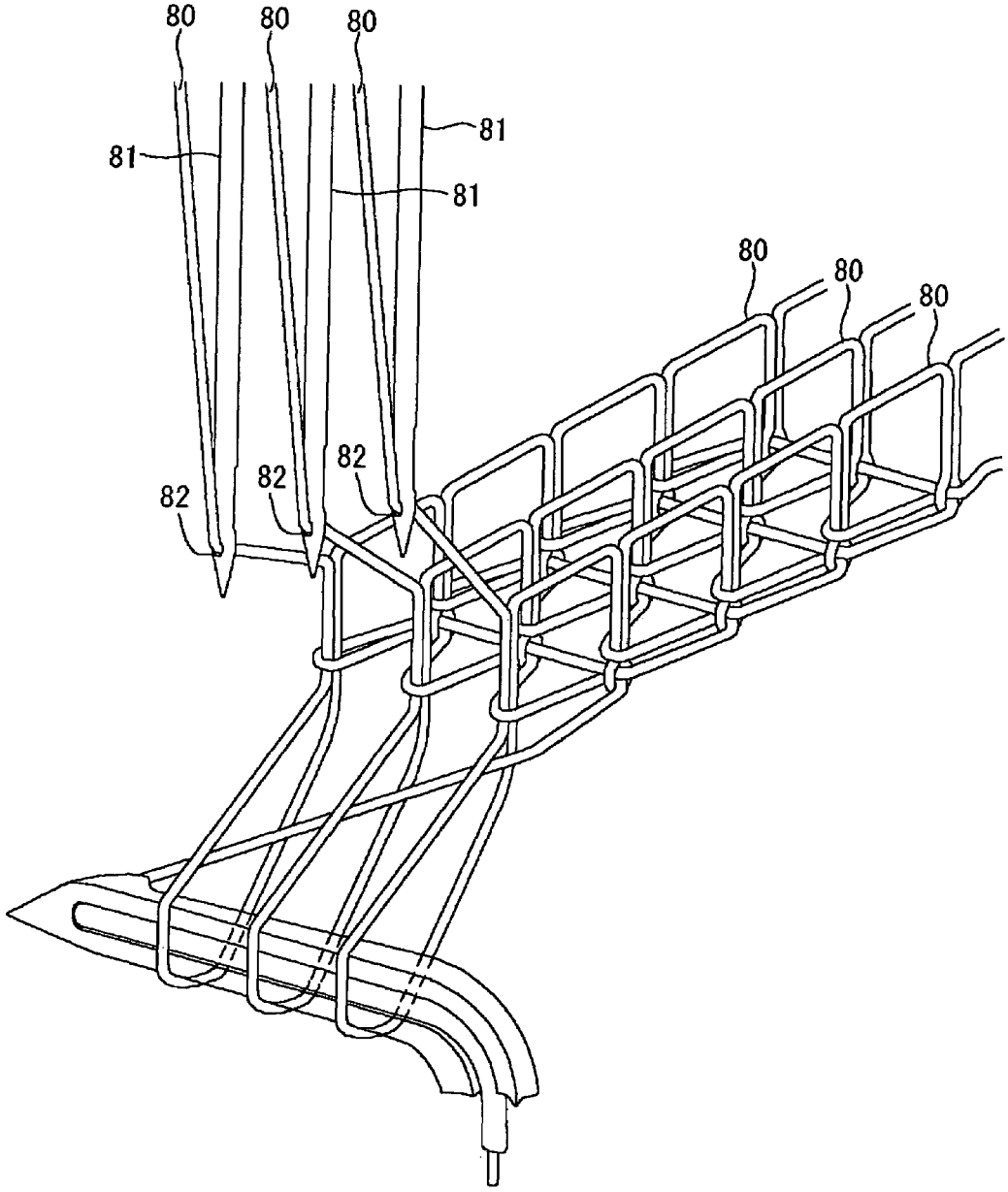
FIG. 9(A) is a seam explanatory view of a conventional cover stitch sewing machine.
Figure 9:
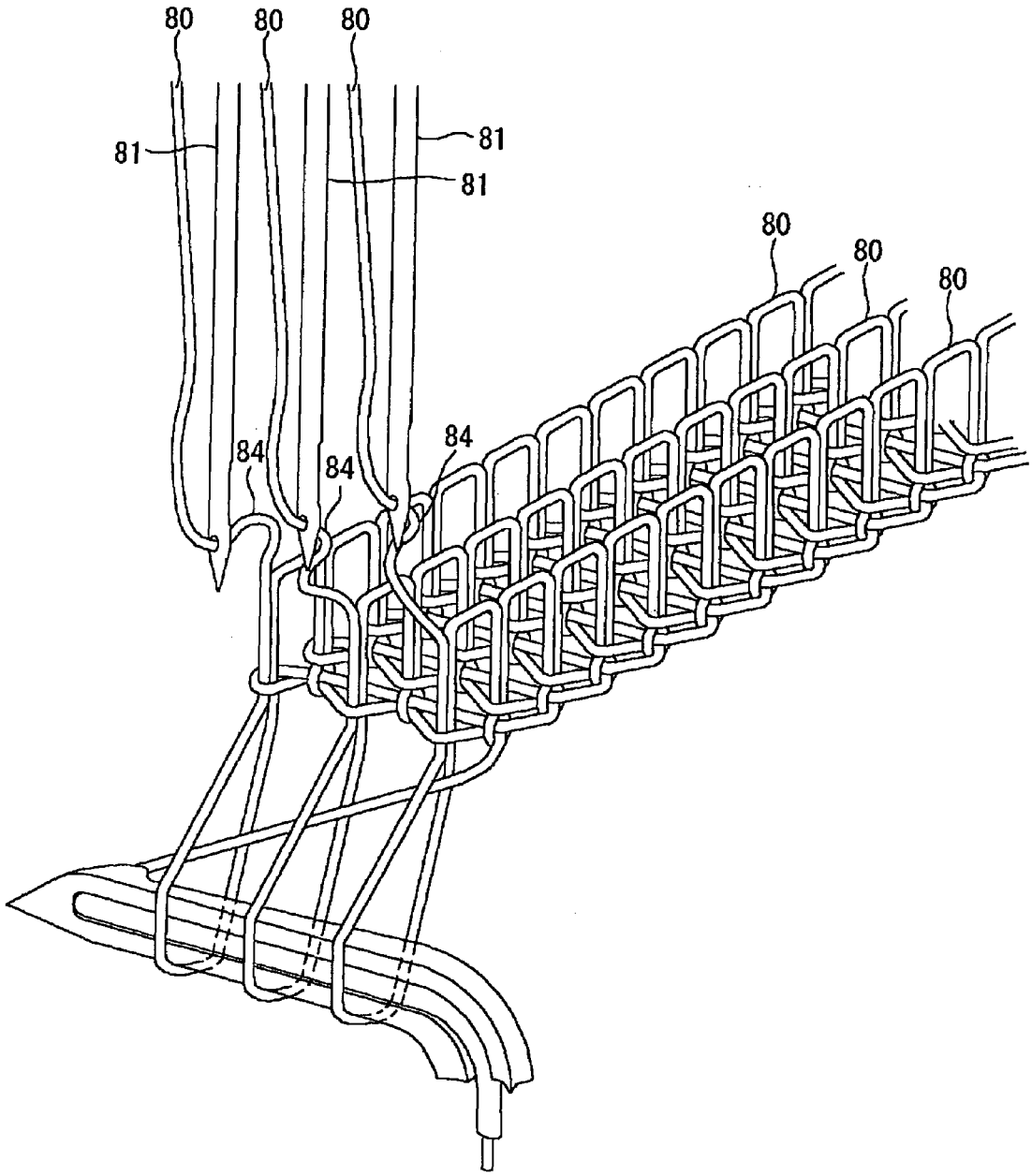
FIG. 9(B) is a seam explanatory view of a conventional cover stitch sewing machine.
Figure 10:
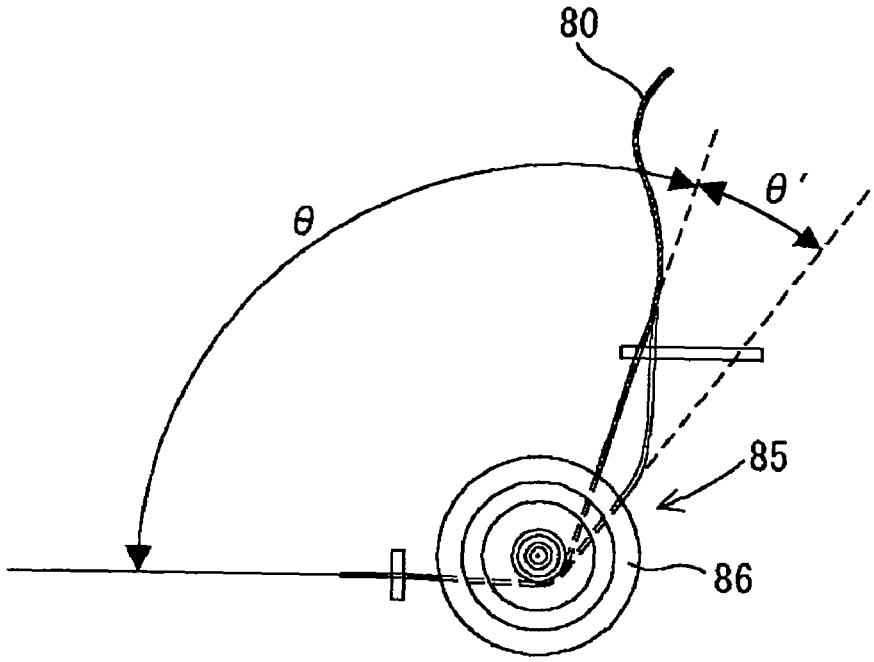
FIG. 10 is an explanatory view showing needle thread tensioning devices of the conventional cover stitch sewing machine.

In performing the sewing with the coarse stitch length as in the case of the related art, since the pulling-in consumption of the needle threads attributed to the fabric feeding is increased, although the feeding quantity of the needle threads is fixed due to the lowering of the needle thread take-up, when the needles are lowered, there is no possibility that the slack is generated in the needle threads which extendedly exist below the needle thread eyes (FIG. 9(A)).

INDUSTRIAL APPLICABILITY

The cover stitch sewing machine of the present invention can, as in the case which allows the sewing machine to be used also for wave lock sewing, prevent the skips in the double chain stitch seams by absorbing the slack of needle threads which extendedly exist below the thread eyes when the plurality of needles are lowered at the time of sewing with the fine stitch length whereby it is possible to apply the present invention not only to the cover stitch sewing machine but also to a flat lock sewing machine or a flat wave lock sewing machine.

What is claimed is:

1. A cover stitch sewing machine in which a plurality of needle threads are supplied to a plurality of needle thread eyes of a plurality of needles from a needle thread spool by way of a plurality of needle thread tensioning devices and a needle thread take-up, a looper thread is supplied to a looper thread eye of the looper from a looper thread spool by way of a looper thread tensioning device and a looper thread take-up, and a cover stitch of a double chain stitch seam is formed in a sewing material on a needle plate due to the intertwining of the needle threads of the respective needles and the looper thread of the looper in response to a cooperative operation of the plurality of needles and the looper, wherein the needle thread take-up includes a needle thread pulling-up spring on which the needle threads which are drawn out from the needle thread tensioning devices are thread-hung together with the needle thread take-up by a thread hanging point and hence, the needle thread take-up completes the drawing-up of the needle threads by the thread hanging point after needle thread loops of the respective needles are seized by the looper, the sewing material is fed by one feed pitch when the plurality of needles are moved down and the needle thread take-up runs out the needle threads, the needle threads are pulled up by the elasticity by the thread hanging point of the needle thread pulling-up spring thus preventing the occurrence of a slack of the needle threads which extendedly exist below the needle thread eyes and, at the same time, the plurality of needles move into the inside of substantially triangular spaces formed by the needle thread loops and the looper threads before one feed pitch, the looper is shed from the needle thread loops, and the needle threads which are connected with the needle thread loops from which the looper is shed are drawn up by the thread hanging point of the needle thread take-up against the resiliency of the needle thread pulling-up spring.

2. A cover stitch sewing machine according to claim 1, wherein the needle thread pulling-up spring has one end thereof fixed to the needle thread take-up and another end thereof elastically flexibly positioned above the thread hanging point of the needle thread take-up.

3. A cover stitch sewing machine according to claim 2, wherein the needle thread pulling-up spring includes a quantity of flexibility to absorb the slack of the needle threads which is generated at the time of sewing with at least a finest stitch length.

4. A cover stitch sewing machine according to any one of claim 2, wherein the needle thread pulling-up spring has the elasticity which is smaller than a drawing-up force of the needle thread take-up and is sufficient to take up the slack of the needle threads which extend below the needle thread eyes.

5. A cover stitch sewing machine according to claims 2, wherein each of the plurality of needle thread tensioning devices comprises a pair of thread tensioning disks, and an implanted-bristle brush which fixes an approach angle of the needle thread which moves into between the pair of thread tensioning disks.

6. A cover stitch sewing machine according to claim 1, wherein the needle thread pulling-up spring includes a quantity of flexibility to absorb the slack of the needle threads which is generated at the time of sewing with at least a finest stitch length.

7. A cover stitch sewing machine according to any one of claim 6, wherein the needle thread pulling-up spring has the elasticity which is smaller than a drawing-up force of the needle thread take-up and is sufficient to take up the slack of the needle threads which extend below the needle thread eyes.

8. A cover stitch sewing machine according to claims 6, wherein each of the plurality of needle thread tensioning devices comprises a pair of thread tensioning disks, and an implanted-bristle brush which fixes an approach angle of the needle thread which moves into between the pair of thread tensioning disks.

9. A cover stitch sewing machine according to claim 1, wherein the needle thread pulling-up spring has the elasticity which is smaller than a drawing-up force of the needle thread take-up and is sufficient to take up the slack of the needle threads which extend below the needle thread eyes.

10. A cover stitch sewing machine according to claims 9, wherein each of the plurality of needle thread tensioning devices comprises a pair of thread tensioning disks, and an implanted-bristle brush which fixes an approach angle of the needle thread which moves into between the pair of thread tensioning disks.

11. A cover stitch sewing machine according to claim 1, wherein each of the plurality of needle thread tensioning devices comprises a pair of thread tensioning disks, and an implanted-bristle brush which fixes an approach angle of the needle thread which moves into between the pair of thread tensioning disks is arranged on an upstream side of each pair of thread tensioning disks.

12. A cover stitch sewing machine according to claim 11, wherein with respect to the implanted-bristle brush, a diameter of implanted bristles is 20 to 30 gr/100 m of synthetic fiber and, a length of the implanted bristles is 2 mm to 3 mm, and the density of the implanted bristles is 30 pieces/$mm^2$.

13. A cover stitch sewing machine according to claim 12, wherein the needle threads are held between a plate which is brought into contact with an implanted-bristle tip face of the implanted bristle and the implanted bristle tip.

14. A cover stitch sewing machine according to claim 11, wherein the needle threads are held between a plate which is brought into contact with an implanted-bristle tip face of the implanted bristle and the implanted bristle tip.

* * * * *

UNITED STATES PATENT AND TRADEMARK OFFICE

CERTIFICATE OF CORRECTION

PATENT NO. : 7,111,568 B1
APPLICATION NO. : 11/336919
DATED : September 26, 2006
INVENTOR(S) : Sakuma et al.

It is certified that error appears in the above-identified patent and that said Letters Patent is hereby corrected as shown below:

Column 9, line 38 (claim 4, line 1) delete “any one of” ;

Column 9, line 44 (claim 5, line 1) “claims” should read -- claim -- ;

Column 10, line 4 (claim 7, line 1) delete “any one of” ;

Column 10, line 11 (claim 8, line 1) “claims” should read -- claim -- ; and

Column 10, line 27 (claim 10, line 1) “claims” should read -- claim -- .

Signed and Sealed this

Thirty-first Day of July, 2007

JON W. DUDAS
*Director of the United States Patent and Trademark Office*